United States Patent [19]

Covino

[11] Patent Number: 4,784,732

[45] Date of Patent: Nov. 15, 1988

[54] ELECTROLYTIC FORMATION OF AN ALUMINUM OXIDE LAYER

[76] Inventor: Charles P. Covino, P.O. Box 265, Boss Rd., Ringoes, N.J. 08551

[21] Appl. No.: 41,723

[22] Filed: Apr. 23, 1987

Related U.S. Application Data

[63] Continuation-in-part of Ser. No. 888,695, Jul. 24, 1986, abandoned.

[51] Int. Cl.[4] ..... C25D 11/08

[52] U.S. Cl. ..... 204/38.3; 204/37.6; 204/58

[58] Field of Search ..... 204/58, 38.3, 37.6

[56] References Cited

U.S. PATENT DOCUMENTS 4,128,461 12/1978 Lerner et al. ..... 204/58
4,193,848 3/1980 Severus-Laubenteid ..... 204/28

OTHER PUBLICATIONS

F. A. Lowenheim, *Electroplating*, McGraw-Hill Book Co., New York, 1978, pp. 452-467.

*Primary Examiner*—John F. Niebling
*Assistant Examiner*—William T. Leader
*Attorney, Agent, or Firm*—Murray Schaffer

[57] ABSTRACT

A process for making an improved composite aluminum article having an intermediate layer of porous coarsely crystalline aluminum oxide integral with the aluminum substrate. The oxide is electrolytically formed by applying a voltage which is steadily and continuously increased from start to finish of the electrolysis from about 5-15 volts to about 65-85 volts at a rate of about 1-3 volts/minute and utilizing a current density which is increased from start to finish of the electrolysis from about 10-30 amps/sq. ft. to about 60-80 amps/sq. ft. at a rate of about 1-3 amps/sq. ft./minute. A preferred electrolyte bath comprises about 15-20 oz./gal. 66°Baumé sulfuric acid, about 2-3 oz./gal. malonic acid, about 2-4 oz./gal. oxalic acid, about 0.5-1 lbs./gal. carbon powder, and about 2-4 oz./gal. sucrose. The crystal lattice of the aluminum oxide layer is saturated with a salt of a divalent or trivalent metal which forms a complex with the aluminum oxide of enhanced strength, hardness and corrosion resistance, and may include the application of a low friction material for enhancing the appearance and function of the treated aluminum article.

4 Claims, No Drawings

ELECTROLYTIC FORMATION OF AN ALUMINUM OXIDE LAYER

RELATED APPLICATION

This is a continuation-in-part of U.S. application Ser. No. 888,695 filed July 24, 1986, now abandoned.

BACKGROUND OF THE INVENTION

This invention relates to an improved aluminum article. This invention also relates to a process for forming the improved aluminum article.

Aluminum articles having treated oxidized surfaces have become well known. The low friction and high corrosion resistance of their surfaces have made such aluminum articles very useful in industry. Aluminum articles having a thin layer of porous irregular coarsely crystalline aluminum oxide formed on their surfaces and a thin coating sealing the porous oxide have been particularly useful. This is because the coating has adhered very strongly and tenaciously to the aluminum substrate and has therefore been highly abrasion resistant. See, for example, U.S. Pat. Nos. 3,533,902 and 3,574,071.

However, the strength, hardness and corrosion resistance (e.g., salt water resistance) of such coated aluminum surfaces have not been considered adequate for many applications, for which the light weight and strength properties of aluminum and the low friction properties of such coated surfaces might otherwise be valuable, for example, in airplanes and in electrical power generating equipment. There has been a need, therefore, for a hard oxidized aluminum surface having enhanced strength, hardness and corrosion resistance properties better than heretofore known.

SUMMARY OF THE INVENTION

In accordance with this invention, an improved composite aluminum article is provided having a) an inner layer of aluminum, b) an intermediate layer of porous coarsely crystalline aluminum oxide integral with the inner layer, and c) if desired, an outer surface of a lubricant or low friction material as, but not limited to, graphite, silicone, molybdenum disulfide, polymers and nylon, and the like. Although the surface may enhance the finished appearance of the article and improve upon its function, its application to the article is not otherwise required or necessary. The improvement in the composite aluminum article comprises:

at least one salt with an anion, a cation or both of a divalent or trivalent metal, which salt is absorbed into, and preferably substantially saturates, the crystal lattice of the aluminum oxide in the intermediate layer to form a complex with the aluminum oxide of enhanced strength, hardness and corrosion resistance.

In accordance with another aspect of this invention, the structure of the aluminum oxide in the intermediate layer comprises highly cellular elongated crystals that are in the form of hollow tubular dendrites densely packed on the surface of the inner layer of aluminum and that are formed electrolytically in an acid bath by:

steadily and continuously increasing the voltage of the impressed current from the start to the finish of the electrolytic process from a voltage of about 5–15 volts to about 65–85 volts at a rate of about 1–3 volts/minute.

In accordance with yet another aspect of this invention, the crystal lattice of the aluminum oxide in the intermediate layer is substantially saturated with at lesst one salt having a cation, an anion or both of a divalent or trivalent metal by a process comprising the steps of:

dehydrating the aluminum oxide to render it hygroscopic; and then treating the aluminum oxide with an aqueous solution or suspension containing the salt.

DETAILED DESCRIPTION OF THE PREFERRED EMBODIMENTS

The improved composite article of this invention is made from an aluminum substrate which can be pure aluminum or an aluminum alloy and can be wrought, cast or forged. After cleaning the surface of the aluminum substrate, an aluminum oxide layer is formed electrolytically on the surface of the aluminum substrate, so that the aluminum oxide is integral with the base aluminum and is irregular, coarsely crystalline and highly porous. This permits surfaces of low friction material to be applied to the aluminum oxide layer to substantially fill all the interstices and pores of the aluminum oxide and strongly and tenaciously bond to the aluminum oxide layer and thereby to the surface of the base aluminum to provide an article of improved function and appearance.

In accordance with this invention, the aluminum oxide layer is formed, as described below, by steadily and continuously increasing the voltage of the impressed current from the start to the finish of the electrolytic process. The resulting unique structure comprises highly cellular elongated aluminum oxide crystals in the form of hollow tubular dendrites densely packed on the surface of the aluminum substrate.

Also in accordance with this invention, the aluminum oxide layer is modified, as described below, by treating it one or more times with a solution or suspension contaning one or more salts with an anion, a cation or both of a divalent or trivalent metal so that each of the salt(s) is absorbed into the crystal lattice of the aluminum oxide and preferably the absorbed salt(s) substantially saturates the crystal lattice of the aluminum oxide. It is believed that such aqueous chemical compounds thereby form a harder, stronger and more corrosion resistant complex with the aluminum oxide. It is also believed that the saturation of the aluminum oxide crystal lattice with such salt(s) causes the interstices and pores of the aluminum oxide to be at least partially filled by the salt(s), thereby increasing the density of the aluminum oxide layer. Examples of salts which can be used to so modify the aluminum oxide are the lower alkanates (e.g., acetate or formate) of nickel, cobalt, lead, zinc and copper and the ammonium, alkali metal and alkaline earth metal dichromates and molybdenates, as well as other conventional salts used for sealing aluminum surfaces. In this treatment, the aluminum oxide layer is preferably saturated with one or more salts by dehydrating the aluminum oxide and then treating it with an aqueous solution or suspension of each salt so that the salt is absorbed by the hygroscopic aluminum oxide layer. Preferably, the modification of the aluminum oxide layer is carried out more than once, using several salts and dehydrating the aluminum oxide between each treatment with a different salt until the aluminum oxide layer is substantially saturated with the several salts. The resulting modified aluminum oxide layer can then be treated with an outer coating or film as described hereinbefore.

In making the improved composite article of this invention, the surface of the aluminum substrate can be cleaned at the outset in a conventional manner to remove dirt, smut, oxide coating, etc. The cleaning method will vary for different aluminum alloys, but conventional methods for preparing aluminum for anodizing can generally be used in this process. In this regard, caustic (e.g., hot aqueous sodium hydroxide) can be used to remove grease and oxide coatings, and acid (e.g., warm aqueous chromic acid-nitric acid) can be used to remove smut. Preferably, the aluminum substrate is cleaned in one step with an aqueous chelated alkaline bath containing about 4–9 oz./gal. of sodium hydroxide and complexing and sequestering agents, having a pH of about 9–11 and a temperature of about 125°–140° F.

After washing the aluminum substrate to remove the cleaning solution(s), the aluminum oxide layer can be grown on the aluminum substrate by electrolytic treatement while immersed in an oxidizing acid bath. The substrate can serve as the anode, and high voltages and current densities can be used to form a highly porous aluminum oxide layer in a conventional manner. A non-etching acid bath for electrolytically growing aluminum oxide crystals can be utilized containing: about 4–8% by volume of sulfuric acid (66° Baumé); about 0.5–3% of each of one or more carboxylic acids such as oxalic, salicylic, malonic, tannic or succinic acid, which preferably amount in total to about 1/5 of the concentration of sulfuric acid; and about 5–25 g/gal. sugar (e.g., sucrose). Preferably, the bath also contains about 0.25–1.7 lbs./gal. of very finely divided (e.g., about 3–6 microns) carbon powder to increase the electrical conductivity of the bath at high voltages. A preferred bath comprises: about 15–20 oz./gal. sulfuric acid (66° Baumé); about 2–3 oz./gal. malonic acid; about 2–4 oz./gal. oxalic acid; about 0.5–1 lbs./gal. carbon powder; and about 2–4 oz./gal. sucrose.

During the formation of the aluminum oxide layer, the acid bath is highly agitated, and high concentrations of dissolved oxygen are maintained in the bath by passing large quantities (e.g., at least about 0.5, preferably about 1–1.5, cubic feet per minute per gallon) of air through the bath to provide the agitation and oxygen requirements of the bath. If desired, a conventional wetting agent can also be added to the bath such as an alkylaryl polyether alcohol wetting agent such as is available under the trademark Triton X-100 of Rohm and Haas Corp., Philadelphia, Pa. The bath is preferably maintained at a temperature of about 25°–80° F., particularly about 26°–36° F., and the temperature of the bath is not allowed to rise substantially during the electrolytic formation of the oxide layer, particularly when high current densities are used. In carrying out this process, a voltage of about 5–130 volts and a current density of about 10–150 amps/sq. ft. can be utilized, along with conventional techniques for growing aluminum oxide crystals electrolytically on aluminum substrates. However, in order to obtain the unique highly cellular structure of the aluminum oxide layer of this invention, with its elongated crystals in the form of hollow tubular dendrites densely packed on the surface of the aluminum substrate, the voltage of the impressed current between anode and cathode should increase steadily and continuously from the start to the finish of the process. Preferably, the voltage is increased from about 5–15 volts to about 65–85 volts, the current density is increased from about 10–30 amps/sq. ft. to about 60–80 amps/sq. ft., the voltage is increased at a rate of about 1–3, preferably 2–3, volts/minute, and the current density is increased at a rate of about 1–3, preferably 1.5–2.5, amps/sq. ft./minute depending upon the aluminum alloy composition. Thereby, small fine aluminum oxide crystals grow in high density on the aluminum substrate at the outset, and the small fine crystals form hollow tubular dendritic crystals as the voltage increases during the process. In this regard, the use of low initial voltages of about 5–15 volts, high final voltages of about 65–85 volts, and a voltage increase at a rate of about 1–3, preferably about 2–3, volts/minute is considered to be very important A suitable aluminum oxide crystal structure, having a thickness of at least about 0.0005 inch, preferably at least about 0.001 inch, up to about 0.005 inch for certain aluminum alloy compositions, can be formed electrolytically within about 30 minutes. This process can, however, take less time or more time (e.g., up to about 90 minutes) depending upon the desired thickness of the aluminum oxide crystal structure and the aluminum alloy composition, but it is preferred that the process take no longer than about 20 minutes. Preferably, the aluminum oxide crystal structure of this invention is grown only to a thickness that will not adversely affect its rigidity and hardness which is generally between about 0.0015 and 0.0025 inch.

The resulting composite of the aluminum oxide layer on the aluminum substrate is then rinsed thoroughly with deionized, preferably distilled, water to remove any residues on its surfaces from the acid bath. This composite is then dried and dehydrated to remove the water of hydration that is bound upon the crystal lattice of the aluminum oxide layer. This drying process can be carried out in a conventional manner at temperatures of about 212° F. or higher for about 15–25 minutes. Preferably, this drying process is carried out by means of a forced air drying oven at a temperature of about 225°–300° F., so that there is rapid and complete dehydration of the aluminum oxide.

Preferably, the resulting hygroscopic aluminum oxide layer is then modified in accordance with this invention by a first treatment with an aqueous solution or suspension containing one or more salts with an anion, a cation or both of a divalent or trivalent metal. In this first treatment, the salt(s) is absorbed with the aqueous medium into the hygroscopic crystal lattice of the aluminum oxide. When the oxide layer is subsequently dried, as described below, the absorbed metal anions, cations or both from the salt(s) form a harder, stronger and more corrosion resistant complex with the aluminum oxide. In carrying out this first treatment, the use of an aqueous colloidal suspension containing at least two metal salts, such as cobalt and nickel salts (e.g., cobalt acetate and nickel acetate), is preferred, and the pH of the suspension is preferably adjusted with a weak acid, such as a lower alkanoic acid (e.g., acetic acid), to be slightly acidic (e.g., a pH of about 5–6) to maintain the salts in suspension. The use of deionized, preferably distilled, water in the suspension is considered very important to prevent contamination of the aluminum oxide by dissolved impurities in the water. The concentrations of the divalent and the trivalent metal salt(s) in the suspension are not critical, but the use of about 2–0 g/l of each salt is preferred, particularly the use, for example, of about 3–8 g/l nickel acetate together with about 2–5 g/l cobalt acetate. In this treatment, the temperature of the aqueous salt suspension also is not critical, but elevated temperatures of about 180°-210° F. are preferred. The manner of treating the aluminum oxide layer with the salt suspension also is not critical, and this first treatment can be suitably carried out simply by immersing the aluminum oxide layer, together with its substrate, in the suspension for example for about 10-40 minutes. Preferably, the period of immersion is adjusted to control the amount of salt absorbed by the aluminum oxide during this first treatment. In this regard, if only one such treatment is to be carried out, the aluminum oxide should be immersed in the aqueous salt(s) solution or suspension until it is substantially saturated with the salt(s), but if more than one such treatment is to be carried out, the aluminum oxide should be immersed during the first treatment only long enough to absorb the desired amount of salt(s) from the first treatment.

The resulting composite of the modified aluminum oxide layer on the aluminum substrate is then rinsed thoroughly with deionized water and then dried and dehydrated in the manner described above. Preferably, the hygroscopic aluminum oxide layer, which results, is then further modified in accordance with this invention by a second treatment with an aqueous solution or suspension containing one or more salts with an anion, a cation or both of a divalent or trivalent metal. In this second treatment, the salt(s) is again absorbed with the solution or suspension into the hygroscopic crystal lattice of the aluminum oxide. When the oxide layer is subsequently dried, as described below, the absorbed metal anions, cations or both from the salt(s) form a harder, stronger and more corrosion resistant crystalline complex with the aluminum oxide. In this second treatment, the use of an alkali metal dichromate as the only salt is preferred, and the pH of its aqueous solution is preferably adjusted with a strong base such as an alkali metal or alkaline earth metal hydroxide so that the solution is only slightly acidic (e.g., a pH of about 4.5-7). The use of deionized water in the salt solution is considered very important to prevent contamination of the aluminum oxide. The concentrations of the strong acid, salt and strong base in this solution are not critical, but the use, for example, of about 75-125 g/l potassium dichromate and about 15-25 g/l potassium hydroxide is preferred. In this treatment, the temperature of its aqueous salt solution also is not critical, but a temperature of about 195°-205° F. is preferred. The manner of treating the aluminum oxide layer with this salt solution also is not critical, and this second treatment can be suitably carried out simply by immersing the aluminum oxide layer with its substrate in the solution, for example, for about 20-40 minutes. Again, the period of immersion is preferably adjusted to control the amount of salt absorbed by the aluminum oxide during the second treatment. Preferably, the second treatment is the last such treatment to modify the aluminum oxide, and its period of immersion is sufficient so that the aluminum oxide is substantially saturated by the combined salt(s) from the first and second treatments. Of course, the order of carrying out the just-described first and second treatments may be reversed, and if desired, additional treatments may be carried out with aqueous solutions and suspensions of other salts, having anions, cations or both of divalent and trivalent metals, so long as the last of such treatments results in the aluminum oxide crystal lattice being substantially saturated with the salts from such treatments.

The resulting composite is then rinsed thoroughly with deionized water and then dried and dehydrated rapidly as described above. The sealed aluminum oxide layer, formed thereby, can have applied to it one of the lubricants as discussed above as by conventional means of application.

The surface of the composite produced by this process has a unique combination of improved properties. The low friction surface of the composite has a hardness of greater than 64 on the Rockwell C scale, and with a composite article made from an aluminum alloy such as 6061 T6, a surface hardness of Rc 68 can be obtained. The composite has a corrosion resistance to salt spray, as measured by ASTM B117-73, which exceeds all currently applicable standards by at least about 500%. The surface of the composite has an abrasion resistance, as measured by ASTM D658-81, using a CS-17 wheel and a 1000 mg. load at 70 rpm, such that the composite lasts 10,000 cycles with a weight loss of only 4-6 mg. The light fastness of the surface of the composite, as measured by ASTM-141, method 6192 and ASTM D2244, exceeds 200 hours to light without water spray. The composite surface shows no staining when tested according to ASTM B136-77. The impedance of the composite, when measured according to ASTM B457-67, exceeds 100 kilohms, and its impedance/admittance, when measured according to ISO 2931 is a minimum of 20 microsiemen. The surface of the composite has an impact strength about 12-20 times greater than its aluminum substrate. The surface of the composite also has an effective temperature operating range of about −350° to +650° F. without significant changes in its strength, toughness of self-lubricating properties.

It is believed that this invention and many of its attendant advantages will be understood from the foregoing description, and it will be apparent that various changes and modifications can be made in the composite aluminum article of this invention and in the process for making the article without departure from the spirit and scope of the invention or sacrificing all of its material advantages, the article and process hereinbefore described being merely preferred embodiments.

What is claimed is:

1. A process for making a composite aluminum article; which comprises immersing an aluminum substrate in an oxidizing acid bath containing sulfuric acid and a carboxylic acid; and electrolytically forming on the surface of the aluminum substrate an irregular, highly porous, and coarsely crystalline aluminum oxide layer integral with such surface by applying to the substrate a voltage which is steadily and continuously increased from start to finish of the electrolysis from about 5-15 volts to about 65-85 volts at a rate of about 1-3 volts/-minute, wherein the current density is increased from start to finish of the electrolysis from about 10-30 amps/sq. ft. to about 60-80 amps/sq.ft. at a rate of about 1-3 amps/sq.ft./minute.

2. The process of claim 1, in which the bath contains about 15-20 oz./gal.66° Baumé sulfuric acid, about 2-3 oz./gl. malonic acid, about 2-4 oz./gal. oxalic acid; about 0.5-1 lbs./gal. carbon powder, and about 2-4 oz./gal. sucrose.

3. The process of claim 1, in which the voltage is increased at a rate of about 2-3 volts/minute, and the current density is increased at a rate of about 1.5-2.5 amps/sq. ft./minute.

4. The process of claim 1, which includes subsequently coating the aluminum oxide layer with a low friction material adherent to the aluminum oxide.

* * * * *